US009175900B2

(12) United States Patent
Borise

(10) Patent No.: US 9,175,900 B2
(45) Date of Patent: Nov. 3, 2015

(54) REFRIGERATOR HAVING SLIDING AND PIVOTING DOORS

(71) Applicant: George Borise, Grant, AL (US)

(72) Inventor: George Borise, Grant, AL (US)

( * ) Notice: Subject to any disclaimer, the term of this patent is extended or adjusted under 35 U.S.C. 154(b) by 0 days.

(21) Appl. No.: 14/564,353

(22) Filed: Dec. 9, 2014

(65) Prior Publication Data

US 2015/0253060 A1 Sep. 10, 2015

Related U.S. Application Data

(60) Provisional application No. 61/947,645, filed on Mar. 4, 2014.

(51) Int. Cl.
*F25D 23/00* (2006.01)
*F25D 23/02* (2006.01)

(52) U.S. Cl.
CPC ..... *F25D 23/021* (2013.01); *F25D 2323/024* (2013.01)

(58) Field of Classification Search
CPC ..... F25D 23/02; F25D 23/021; F25D 23/028; F25D 2323/02; F25D 2323/022; F25D 2323/024; Y10T 16/545
USPC ..... 49/246, 247, 250, 254, 257, 258, 259
See application file for complete search history.

(56) References Cited

U.S. PATENT DOCUMENTS

| | | | | |
|---|---|---|---|---|
| 5,040,857 | A * | 8/1991 | Mandel | E05D 3/022 16/364 |
| 5,720,182 | A | 2/1998 | Imre | |
| 6,253,568 | B1 | 7/2001 | Peffley | |
| 6,971,250 | B1 | 12/2005 | Imre et al. | |
| D517,572 | S | 3/2006 | Imre et al. | |
| 8,454,103 | B2 | 6/2013 | Jeon et al. | |
| 8,484,895 | B2 * | 7/2013 | Kuhnmuench | E05D 15/48 49/149 |
| 9,074,810 | B2 * | 7/2015 | Hwang | F25D 23/02 |
| 2011/0083465 | A1 * | 4/2011 | Kim | F25D 25/027 62/449 |
| 2013/0199232 | A1 * | 8/2013 | Natarajan | F25B 7/00 62/335 |

* cited by examiner

*Primary Examiner* — Daniel Rohrhoff
(74) *Attorney, Agent, or Firm* — Global Intellectual Property Agency LLC; Daniel Boudwin

(57) ABSTRACT

A refrigerator having sliding doors that is easily accessible by handicapped individuals, such as individuals in wheelchairs. The refrigerator includes a rectangular housing having a pair of doors thereon that is arranged side-by-side. The doors are secured to the housing via upper and lower rails. The upper and lower rails are disposed within upper and lower tracks on the rectangular housing. The rails can slide within the tracks and may further be telescopic, allowing the doors to open in a sliding motion. In this way, a user can access the refrigerator without having the doors swing outwards and towards the user. The doors are also attached to the rails via a hinge so that the doors can pivot open in the traditional manner. Thus, the refrigerator can be opened by sliding or pivoting, or a combination thereof, for easy access by handicapped individuals.

9 Claims, 4 Drawing Sheets

REFRIGERATOR HAVING SLIDING AND PIVOTING DOORS

CROSS REFERENCE TO RELATED APPLICATION

This application claims the benefit of U.S. Provisional Application No. 61/947,645 filed on Mar. 4, 2014, entitled "Handicapped Accessible Refrigerator." The above identified patent application is herein incorporated by reference in its entirety to provide continuity of disclosure.

BACKGROUND OF THE INVENTION

1. Field of the Invention

The present invention relates to a handicap accessible refrigerator. More specifically, the present invention provides a handicap accessible refrigerator comprising doors that both slide and pivot in order allow a user in a wheelchair or similar device to more easily access the interior of the refrigerator. The device includes a pair of vertical doors mounted on rails slidably positioned within tracks on the refrigerator housing, such that the doors can slide outward towards the sides of the refrigerator so that users can gain access to the refrigerator without having to open the doors towards themselves.

Individuals with disabilities, such as individuals in wheelchairs, have difficulty gaining access to kitchen storage areas, including refrigerators. When a user is seated in a wheelchair, the user must move close toward the refrigerator in order to reach the door. However, traditional refrigerators include doors that swing open towards the user. Thus, the handicapped individual and his or her wheelchair may impede the path of the door as it is opening and may have to maneuver out of the way. The user must then move towards the interior of the refrigerator in order to retrieve items stored therein. This process is inconvenient and frustrating for handicapped individuals who desire any easier way to access the interior of a refrigerator.

The present invention provides a refrigerator that is easily accessible by handicapped individuals. The refrigerator includes a pair of vertical doors arranged side-by-side. Each door is connected to the refrigerator housing via an upper rail and a lower rail, each rail is slidably positioned within a track on the housing. The upper and lower rails are adapted to extend outward from the refrigerator such that the doors can slide open. Further, each door is pivotally connected to the rails so that the door can open by pivoting in the traditional manner. Thus, the present invention provides a refrigerator with doors that open in a sliding fashion and in a pivoting fashion.

2. Description of the Prior Art

Devices have been disclosed in the prior art that relate to refrigerators of various construction. These include devices that have been patented and published in patent application publications. These devices generally relate to refrigeration systems having doors that swing outward. The following is a list of devices deemed most relevant to the present disclosure, which are herein described for the purposes of highlighting and differentiating the unique aspects of the present invention, and further highlighting the drawbacks existing in the prior art.

One such device, U.S. Pat. No. 6,253,568 to Peffley discloses a refrigerator having a slidably positioned freezer compartment. A frame is slidably disposed in the freezer compartment and can slide outward from the refrigerator, towards the front of the refrigerator. Thus, Peffley discloses a sliding compartment rather than sliding doors. Further, the compartment of Peffley slides towards the user or the front of the refrigerator, and not to the sides of the refrigerator. Thus, Peffley is not adapted for easy accessibility by a handicapped individual.

U.S. Pat. No. 8,454,103 to Jeon et al. discloses a refrigerator having left and right doors that are pivotally opened and closed. Further, a sliding door is positioned between the left and right doors. The sliding door slides outward towards the user who is opening the refrigerator. Thus, while Jeon et al. discloses a refrigerator with a sliding door, Jeon et al. does not disclose a refrigerator having a left and right door that can open by sliding the doors towards the sides of the refrigerator in order to facilitate access to the refrigerator by a handicapped individual.

U.S. Pat. No. 6,971,250 to Imre et al. discloses a refrigerator having an elliptical cross section and a refrigeration compartment. The compartment has two or more shelves that are rotatable about a vertical axis. Each sidewall of the compartment includes at least one door member to provide access to the shelf members. Preferably, the doors are transparent. A refrigeration unit supplies cooling air to the compartment in order to cool the food therein. Similarly, U.S. Design Patent Number D517,572 to Imre et al. discloses the ornamental design for a refrigerator having transparent doors. The refrigerator comprises an elliptical housing and a plurality of transparent doors on the sidewalls thereof. Imre et al., however, fails to disclose a refrigerator having a rectangular housing with doors that open either slidably or pivotally.

Finally, U.S. Pat. No. 5,720,182 to Imre discloses a refrigeration system having a vacuum panel insulated cabinet having mirrored cylindrical compartments. The compartments are accessed by sliding doors. The compartments are cooled with water that passes through water jackets surrounding the compartments. Cold air can also be used to cool the compartments. Thus, Imre discloses a refrigeration system having cylindrical compartments, and does not disclose a conventional household refrigerator adapted to facilitate accessibility by handicapped individuals.

These prior art devices have several known drawbacks. The prior art devices include refrigeration systems with sliding compartments. These compartments slide outward towards the front of the refrigerator. Such an arrangement is inconvenient for a handicapped individual, who must move away from the door as it is opening towards the user. The prior art devices fail to disclose a conventional household refrigerator having a left door and a right door, wherein the doors can open pivotally in the conventional manner, but can also slide outwards towards the sides of the refrigerator to provide access to the interior of the refrigerator.

In light of the devices disclosed in the prior art, it is submitted that the present invention substantially diverges in design elements from the prior art and consequently it is clear that there is a need in the art for an improvement to existing refrigerator devices. In this regard the instant invention substantially fulfills these needs.

SUMMARY OF THE INVENTION

In view of the foregoing disadvantages inherent in the known types of refrigerators now present in the prior art, the present invention provides a new refrigerator wherein the same can be utilized for providing convenience for a handicapped user when gaining access to the interior of the refrigerator.

It is therefore an object of the present invention to provide a new and improved refrigerator door device that has all of the advantages of the prior art and none of the disadvantages.

It is another object of the present invention to provide a refrigerator that includes sliding doors that is easily accessible by a handicapped individual.

Another object of the present invention is to provide a refrigerator that includes doors that can be opened by pivoting the doors about a hinge.

Yet another object of the present invention is to provide a refrigerator that includes doors that can be opened by sliding rails attached to the doors within tracks on the refrigerator housing.

Another object of the present invention is to provide a refrigerator that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
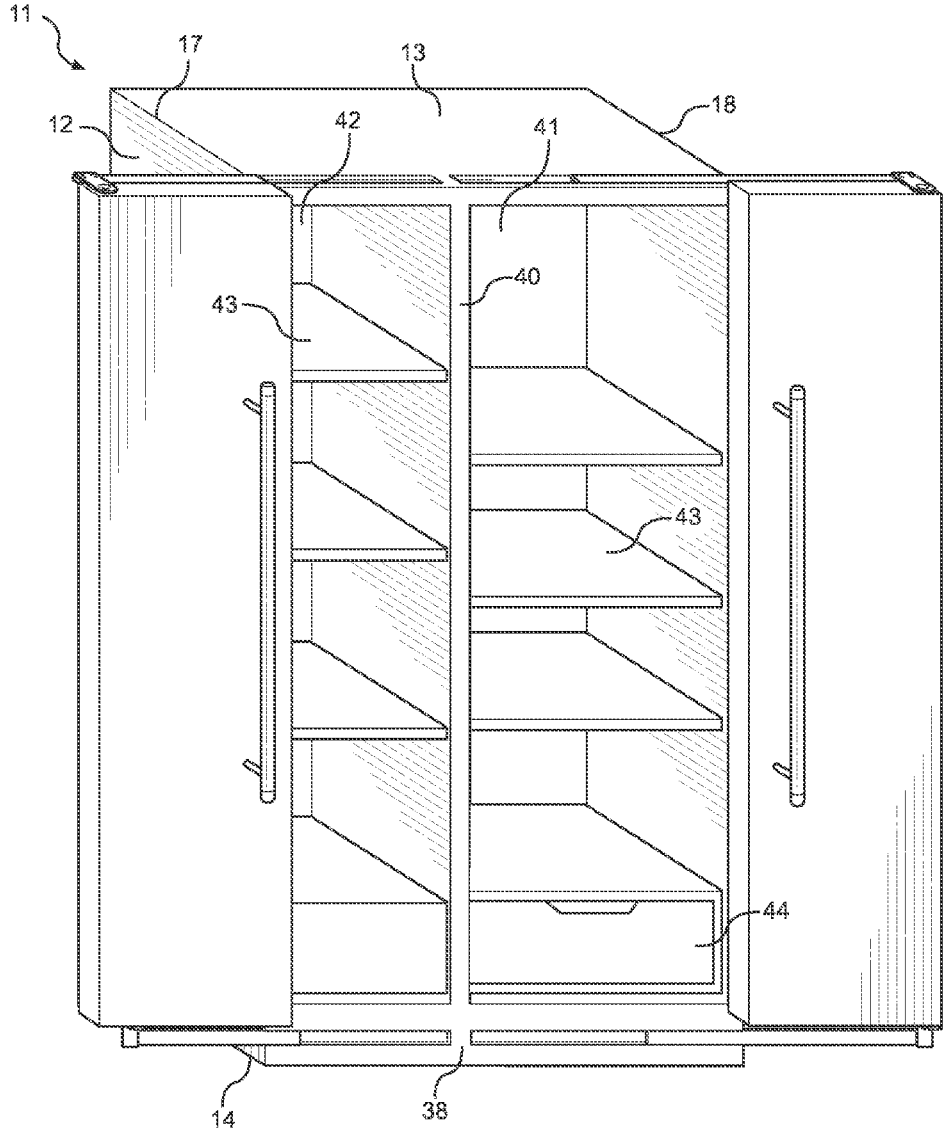
FIG. 1 shows a view of the interior of the refrigerator of the present invention.

Reference is made herein to the attached drawings. Like reference numerals are used throughout the drawings to depict like or similar elements of the refrigerator. For the purposes of presenting a brief and clear description of the present invention, the preferred embodiment will be discussed as used for allowing a handicapped individual to easily access a refrigerator. The figures are intended for representative purposes only and should not be considered to be limiting in any respect.

Referring now to FIG. 1, there is shown a view of the interior of the refrigerator of the present invention. The present invention provides a refrigerator 11 comprising a substantially rectangular housing 12 having a bottom end 14, a rear wall, a pair of sidewalls 17, 18, a top wall 13, and a partially open front wall. The front wall includes a closed lower end 38, wherein the remainder of the front wall is substantially open. The rectangular housing 12 defines an interior volume in which various food items can be stored. Preferably, the housing 12 is divided into a first compartment 41 on the right side of the refrigerator and a second compartment 42 on the left side of the refrigerator by means of an interior dividing wall 40. The compartments 41, 42 are completely separated by the dividing wall 40 so that one compartment is used as a refrigerator, and the other compartment is used as a freezer. Each compartment 41, 42 includes a plurality of removable shelves 43 therein so that a user may arrange a desired number of shelves 43 at desired elevations within each compartment 41, 42. Further, each compartment 41, 42 may include one or more drawers 44 therein for additional storage.

Figure 2:
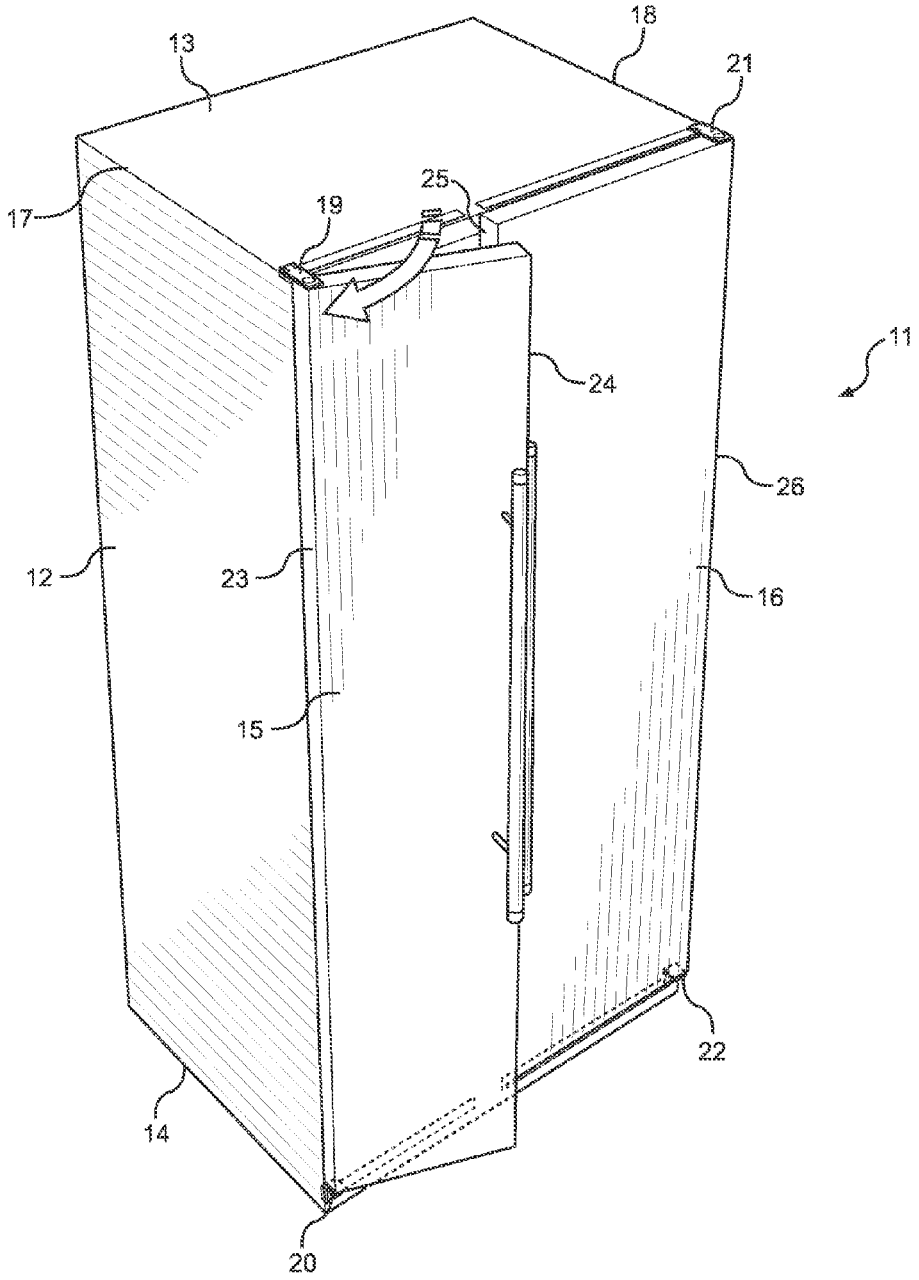
FIG. 2 shows a perspective view of the refrigerator of the present invention wherein the doors open in a pivoting motion.
Figure 3:
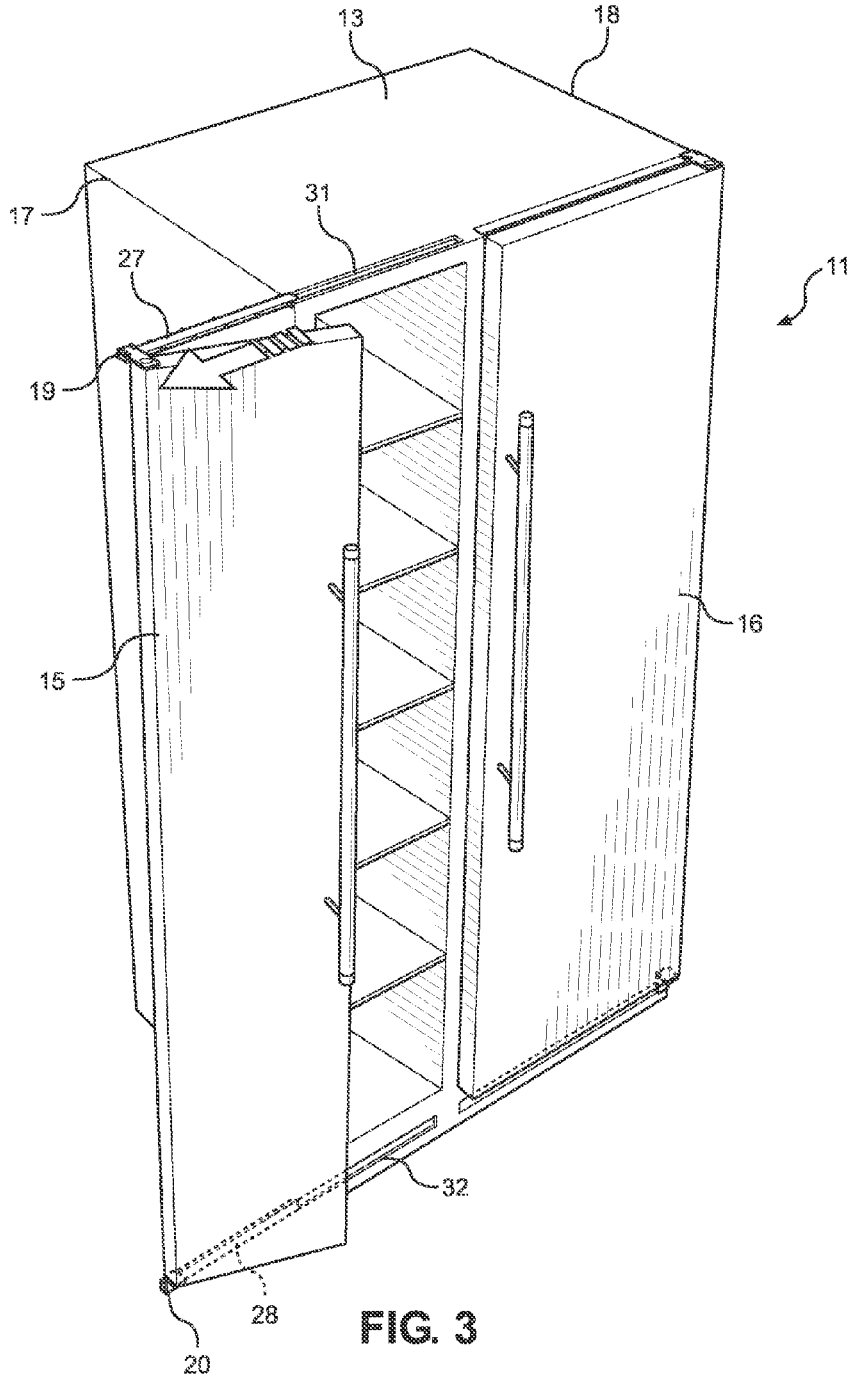
FIG. 3 shows a view of the refrigerator of the present invention wherein the doors open in a sliding motion.

Referring now to FIGS. 2 and 3, there are shown views of the doors of the refrigerator of the present invention. The open front wall of the refrigerator 11 includes a first door 15 and a second door 16 thereon. Each door 15, 16 comprises an elongated rectangular panel having a height greater than its width. The doors 15, 16 are preferably similar in dimension such that each door 15, 16 covers approximately half of the front wall of the refrigerator 11. In the illustrated embodiment, the first door 15 covers and seals the second compartment and the second door 16 covers and seals the first compartment. Each door may include a magnetic seal about the perimeter thereof to help secure the doors in a closed position over the first and second compartments. Each of the doors 15, 16 comprises an outer side 23, 26 and an inner side 24, 25, respectively. The outer sides 23, 26 are positioned adjacent the sidewalls of the refrigerator 17, 18, wherein the outer side 23 of the first door 15 is adjacent to the first side 17 of the refrigerator 11 and the outer side 25 of the second door 16 is adjacent to the second side 18 of the refrigerator 11. The inner sides 24, 25 of the doors 15, 16 are adjacent to one another when the doors 15, 16 are in a closed configuration.

The first door 15 includes a top hinge 19 on an upper end thereof and a bottom hinge 20 on a lower end thereof. The hinges 19, 20 are positioned on the outer side 23 of the door 15. The top hinge 19 is on the upper end of the door 15 and is connected to a terminal end of an upper rail 27, while the bottom hinge 20 is on the lower end of the door 15 and is connected to a terminal end of a lower rail 28. Similarly, the second door 16 includes a top hinge 21 on the upper end thereof and a bottom hinge 22 on the lower end thereof. The top and bottom hinges 21, 22 are disposed on the outer side 26 of the door 16. The top hinge 21 is connected to the terminal end of a second upper rail, while the bottom hinge 22 is connected to the terminal end of a second lower rail. The hinges allow the doors to move pivotally between open and closed configurations. Thus, the doors 15, 16 are capable of opening by rotating outward and towards the user as in a conventional refrigerator.

Each door 15, 16 is also capable of opening by sliding in a plane parallel to the front wall of the refrigerator 11. Each door 15, 16 includes an upper rail attached to the upper end thereof and a lower rail attached to the lower end thereof. The upper and lower rails may be telescopic so as to allow the doors to extend outward from the refrigerator. The upper rail 27 is positioned within an upper track 31 on the top wall 13 of the housing and the lower rail 28 is positioned within a lower track 32 on the lower end 38 of the front wall of the housing. In this way, the rails 27, 28 can slide within the tracks 31, 32 outward, and towards the sides of the refrigerator 11 in order to provide a user with access to the interior volume of the refrigerator 11. This allows a handicapped individual in a wheelchair to move close towards the refrigerator and simply slide the doors rather than opening the doors outwards and towards the user.

Figure 4:
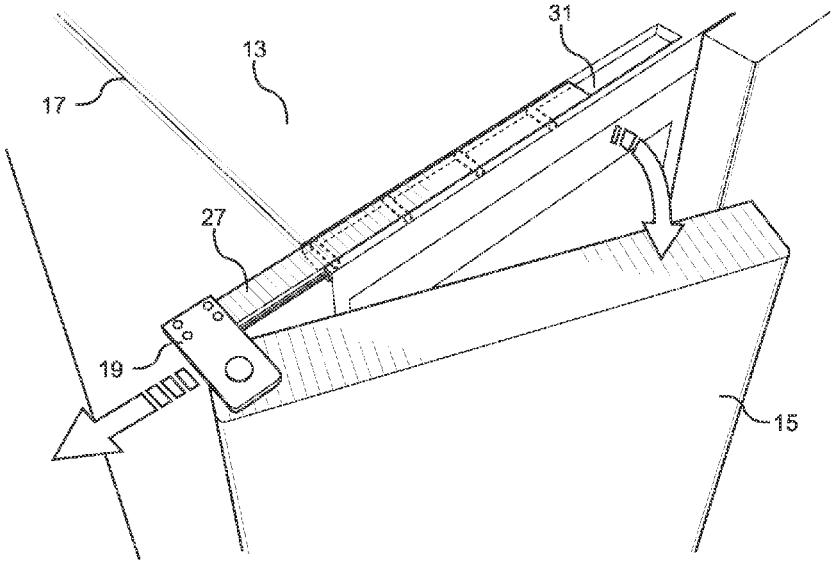
FIG. 4 shows a close-up view of the upper portion of the refrigerator of the present invention.
Figure 5:
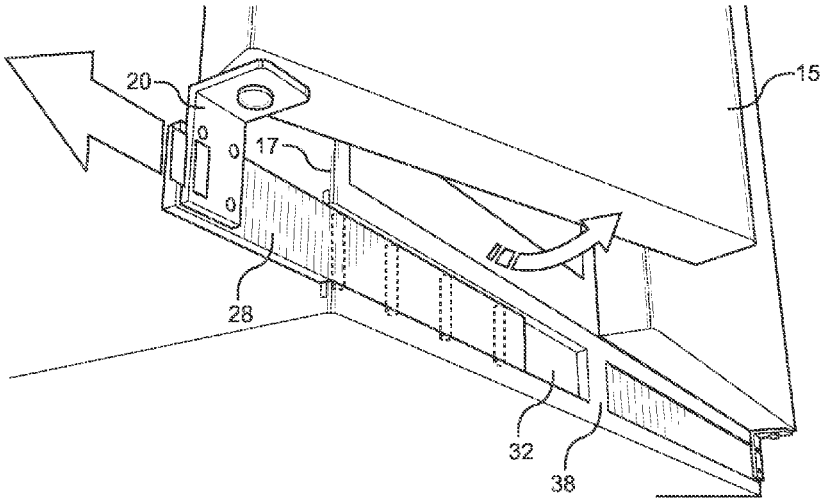
FIG. 5 shows a close-up view of the lower portion of the refrigerator of the present invention.

Referring now to FIGS. 4 and 5, there are shown close-up views of the upper and lower tracks of the present invention. The illustrated embodiment shows the sliding mechanism on the first door 15 of the invention, and the second door operates in the same manner as the first door and the foregoing applies equally to the second door of the present invention.

The top wall 13 of the refrigerator 11 includes a first upper track 31 and a second upper track thereon. The first and second upper tracks are disposed on the front end of the top wall 13 and are parallel to the front wall of the refrigerator. The first upper track 31 extends from the sidewall 17 of the refrigerator 11 towards a mid-portion of the top wall 13. The second upper track extends from the opposite sidewall of the refrigerator towards a mid-portion of the top wall 13. In this way, the first and second upper tracks are arranged in a side-by-side orientation. The first and second upper tracks comprise elongated recessed areas disposed on the top wall 13 of the rectangular housing.

Additionally, a first bottom track 32 and a second bottom track are disposed on the lower end of the front wall 38. The first and second bottom tracks are arranged horizontally and are collinear. The first and second bottom tracks are elongated recessed areas, similar to the first and second upper tracks. The first bottom track extends from the first side 17 of the refrigerator to a mid-point of the front wall 38. Similarly, the second bottom track extends from the second side of the refrigerator to a mid-point of the front wall 38. Thus, the first and second bottom tracks are also arranged in a side-by-side orientation. Further, it is contemplated that the first bottom track is aligned with the first upper track, and second bottom track is aligned with the second upper track.

In the illustrated embodiment, the first door 15 is shown, however the second door operates in the same manner as the first door. The door 15 comprises an upper hinge 19 and a lower hinge 20. The hinges 19, 20 are located on the outer side of the door 15. The upper hinge 19 is connected to an end of the first upper rail 27, wherein the first upper rail 27 is slidably disposed within the upper track 31. Similarly, the first bottom hinge 20 is secured to an end of the first bottom rail 28, wherein the first bottom rail 28 is slidably disposed within the first bottom track 32. In this way, the door 15 can be opened via a sliding motion by moving the upper rail 27 within the upper track 31 while moving the lower rail 28 within the lower track 32. By sliding the door 15, the interior volume of the refrigerator is accessible.

The upper and lower rails 27, 28 are constructed so as to prevent the rails 27, 28 from exiting the upper and lower tracks 31, 32 respectively. Thus, once the rails 27, 28 are moved outward from the tracks 31, 32 to a certain extent, the rails 27, 28 are prevented from further movement so that the door 15 does not move off of the tracks 31, 32. Further, while the doors are moving slidably, the doors can still be rotated about the hinges 19, 20 thereon. In this way, a handicapped individual can approach the refrigerator, and slide the doors open so that the handicapped individual does not have to move away from the fridge to make room for the door as it opens. Once the doors slide open, the user can rotate the doors about the hinges so as to gain access to the inner surface of the doors. In some embodiments, the inner surface of the doors may comprise shelves or compartments thereon so as to store food and other items therein.

The device further includes a conventional refrigeration unit. The refrigeration unit passes a coolant or refrigerant through a compressor and a series of coils. The coolant is passed through a condensing unit and then through an expansion valve to cool the coolant. In this way, the coolant is circulated in order to cool the first and second compartments of the refrigerator of the present invention. The refrigeration unit of the present invention is constructed and operates similar to conventional refrigerators. Additionally, a thermostat and one or more dials are provided that allows a user to set the operating temperature of the refrigerator compartment and freezer compartment of the refrigerator of the present invention. The specific configuration of the refrigeration unit, the thermostat, and the dials, however, is not of primary relevance with regard to the intent of the present invention, which portends to provide an improved opening mechanism for refrigerators.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handicap accessible refrigerator, comprising:

a rectangular housing having a bottom end, a first sidewall, a second sidewall, a rear wall, a top wall, and a front wall that is substantially open, defining an interior volume;

wherein said top wall includes a first upper track and a second upper track thereon;

wherein a lower end of said front wall includes a first lower track and a second lower track thereon;

a first door having a first upper hinge and a first lower hinge, said first upper hinge secured to a first upper rail and said first lower hinge secured to a first lower rail, said first upper rail slidably positioned within said first upper track and said first lower rail slidably positioned within said first lower track;

a second door having a second upper hinge and a second lower hinge, said second upper hinge secured to a second upper rail and said second lower hinge secured to a second lower rail, said second upper rail slidably positioned within said second upper track and said second lower rail slidably positioned within said second lower track.

2. The handicap accessible refrigerator of claim 1, wherein said interior volume of said rectangular housing includes a refrigerator compartment and a freezer compartment.

3. The handicap accessible refrigerator of claim 2, wherein said refrigerator compartment and said freezer compartment comprises one or more removable shelves therein.

4. The handicap accessible refrigerator of claim 1, wherein said first upper track and said second upper track are disposed on a front end of said top wall.

5. The handicap accessible refrigerator of claim 1, wherein said first upper track and said second upper track comprise elongated recessed areas.

6. The handicap accessible refrigerator of claim 1, wherein said first upper hinge and said first lower hinge on said first door are positioned on an outer side of said first door.

7. The handicap accessible refrigerator of claim 1, wherein said first upper track and said second upper track are in a side by side orientation.

8. The handicap accessible refrigerator of claim 1, wherein said first lower track and said second lower track are in a side by side orientation.

9. The handicap accessible refrigerator of claim 1, wherein said first upper track is aligned with said first lower track, and said second upper track is aligned with said second lower track.

* * * * *